US008576038B2

(12) United States Patent
Kraemer et al.

(10) Patent No.: US 8,576,038 B2
(45) Date of Patent: Nov. 5, 2013

(54) TAP CHANGER WITH A POLARITY SWITCH FOR A VARIABLE TRANSFORMER

(75) Inventors: Axel Kraemer, Regensburg (DE); Dazhong Shen, Neutraubling (DE)

(73) Assignee: Maschinenfabrik Reinhausen GmbH, Regensburg (DE)

( * ) Notice: Subject to any disclaimer, the term of this patent is extended or adjusted under 35 U.S.C. 154(b) by 0 days.

(21) Appl. No.: 13/497,089

(22) PCT Filed: Nov. 2, 2010

(86) PCT No.: PCT/EP2010/006665

§ 371 (c)(1), (2), (4) Date: Apr. 18, 2012

(87) PCT Pub. No.: WO2011/076309

PCT Pub. Date: Jun. 30, 2011

(65) Prior Publication Data

US 2012/0249277 A1 Oct. 4, 2012

(30) Foreign Application Priority Data

Dec. 23, 2009 (DE) ..... 10 2009 060 132

(51) Int. Cl.

| | |
|---|---|
| ***H01F 21/12*** | (2006.01) |
| ***H01F 21/02*** | (2006.01) |
| ***H01F 27/28*** | (2006.01) |
| ***H01F 21/08*** | (2006.01) |

(52) U.S. Cl.

USPC ..... 336/150; 336/145; 336/182; 336/155; 336/165

(58) Field of Classification Search

USPC ..... 336/150, 145, 182, 155, 165

See application file for complete search history.

(56) References Cited

U.S. PATENT DOCUMENTS

| | | | | |
|---|---|---|---|---|
| 3,581,188 | A * | 5/1971 | Watanabe et al. | 323/340 |
| 4,207,445 | A * | 6/1980 | Hammar | 200/11 TC |
| 4,255,734 | A * | 3/1981 | Owen | 336/147 |
| 6,849,813 | B1 | 2/2005 | Albrecht | |
| 6,856,122 | B2 * | 2/2005 | Dohnal et al. | 323/258 |

FOREIGN PATENT DOCUMENTS

| | | | |
|---|---|---|---|
| DE | 047965 | B | 5/1966 |
| DE | 2421278 | A | 11/1975 |
| DE | 3224860 | A | 3/1983 |
| DE | 3622716 | A | 1/1988 |
| DE | 19542880 | B | 2/1997 |
| GB | 1045612 | B | 10/1966 |
| GB | 1267284 | B | 3/1972 |
| JP | 55133515 | B | 10/1980 |

* cited by examiner

*Primary Examiner* — Elvin G Enad
*Assistant Examiner* — Kazi Hossain
(74) *Attorney, Agent, or Firm* — Andrew Wilford

(57) ABSTRACT

The invention relates to a step switch provided with a preselector and a polarity circuit, a separate polarization resistance being respectively provided at the beginning and the end of the stepped winding. Optionally, the two polarization resistances can be connected continuously or via separate polarity switches.

4 Claims, 2 Drawing Sheets

TAP CHANGER WITH A POLARITY SWITCH FOR A VARIABLE TRANSFORMER

CROSS REFERENCE TO RELATED APPLICATIONS

This application is the US-national stage of PCT application PCT/EP2010/006665 filed 2 Nov. 2010, published 30 Jun. 2011 as 2011/076309, and claiming the priority of German patent application 102009060132.5 itself filed 23 Dec. 2009.

FIELD OF THE INVENTION

The invention relates to a tap changer provided with a preselector and with a polarity circuit for uninterrupted regulation at a regulating transformer.

DE 19 42 567 [GB 1,267,284] describes a tap changer with a preselector for selectable serial connection of taps of the tap windings with the associated main winding of a tapped transformer, in which the reversing contacts of the tap changer are constructed as changeover contacts.

In such tap changers the tap winding of the corresponding tapped transformer is briefly electrically separated from the main winding during actuation of the preselector. In that case it adopts a potential that results from the voltages of the adjacent windings as well as the coupling capacitances with respect to these windings or to earthed components. The thus-arising difference voltages load the switching path of the opening preselector contacts and can have the consequence of, inter alia, unacceptable discharge phenomena at the preselector. In order to avoid this it is known to briefly connect the center of the tap winding via a polarity resistance with a fixed point of the main winding, frequently the star point of the transformer, by a polarity switch during the switching-over phase and thus couple the tap winding to a defined potential.

DE 32 24 860 A describes a similar arrangement at a tap changer, in which—shown there in FIG. 1b—a polarity resistance is, similarly again, connected with the center of the tap winding.

DE 195 42 880 C1 shows a polarity switch particularly suitable for such a transient connection of the center of the tap winding.

It is known from JP 55-133515 A and DD 47965 B1 to arrange at a tap changer, which is provided with a preselector and has a polarity circuit for uninterrupted regulation at a regulating transformer by the regulating winding, voltage-dependent resistances for protection against over-voltages during switching of the preselector.

DE 24 21 728 A1 describes a tap changer provided with a preselector and with a polarity circuit, wherein by the regulating winding voltage-dependent resistances are arranged in combination with oil spark paths for protection against over-voltages during switching of the preselector.

Finally, it is already known from DE 11 65 154 [GB 2,045, 612] to connect, in a tap changer provided with a preselector, the center tap of the regulating winding with the load shunt by a voltage-dependent resistance for protection against over-voltages during switching of the preselector and to provide voltage-dependent resistances in parallel with the connections of the regulating winding.

In general, the prior art with respect to tap changers, which are provided with preselectors, with a polarity circuit can be summarized as follows: a polarity resistance is provided between the center of the tap winding and the load shunt, which is connected—constantly or transiently only during the switching-over—with the load shunt by a polarity switch before the start of the preselector actuation. The tap winding is thereby coupled with a defined potential during the preselector switching.

It is disadvantageous with these known solutions that due to this polarity switching by the preselector the undesired capacitive current is switched, i.e. interrupted; arcs are then inevitable. These arcs cause formation of gas. This is undesirable for numerous applications, for example in the case of ultra-high-voltage applications. These undesired gases are increasingly disruptive with increasing system voltage.

OBJECT OF THE INVENTION

It is accordingly the object of the invention to provide a tap changer with an improved polarity circuit that is accompanied by significantly reduced formation of arcs at the preselector.

SUMMARY OF THE INVENTION

The general inventive concept, which applies to both embodiments of the invention, consists of providing two separate polarity resistances that are connected with the start and the end of the tap winding.

The significant advantage of the two forms of embodiment of the invention consists in that the two polarity resistances provided in accordance with the invention form a bypass for the capacitive current; the capacitive current commutates from one side to the other side and in departure from the prior art it does not have to be switched off, i.e. interrupted, by the preselector. As a consequence, a significantly lower degree of arc formation arises.

BRIEF DESCRIPTION OF THE DRAWING

The invention is explained in more detail in the following by drawings, in which.

DETAILED DESCRIPTION OF THE INVENTION

Figure 1:
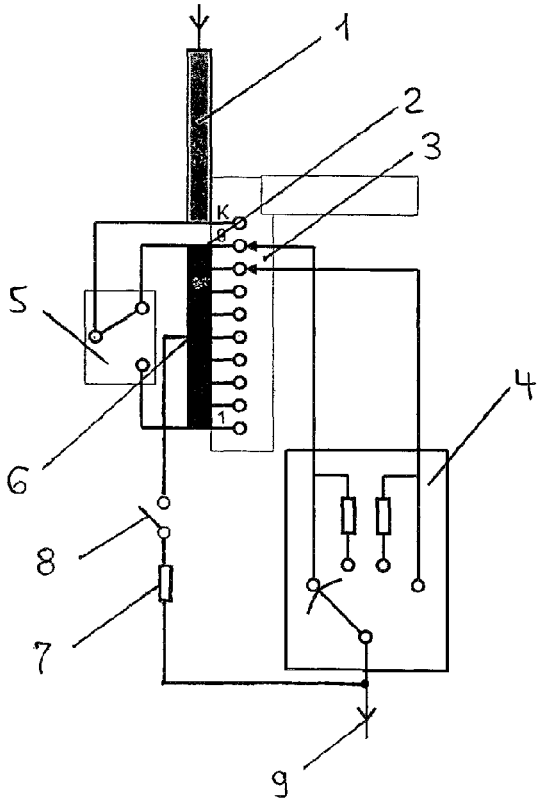
Fig. 1 Prior Art
FIG. 1 shows an arrangement according to the prior art.

Initially, a prior art polarity arrangement shall be explained again by FIG. 1. A main winding 1 and a tap winding 2 of a tapped transformer are shown. A tap changer, which has a selector 3, is connected with the tap winding 2. The selector 3 before a switching-over process initially preselects, free of power, the new winding tap of the tap winding 2, which is to be switched over to. The switching-over itself is carried out by a known load changeover switch 4 of the tap changer, which does not need to be discussed here in more detail. In addition, the tap changer comprises a preselector 5 that, for increasing the regulating range at the start or end of the tap winding 2, can be connected with the end of the main winding 1. The actual polarity circuit consists of a polarity resistance 7 that is coupled with the center 6 of the tap winding 2 and is connected either directly with the load shunt 9 or, as shown here, only transiently with the load shunt 9 by a polarity switch 8.

The constant coupling of the polarity resistance 7—although it is needed only during the switching-over—causes additional transformer losses, for which reason in most cases a polarity switch 8 is inserted in the polarity circuit.

Figure 2:
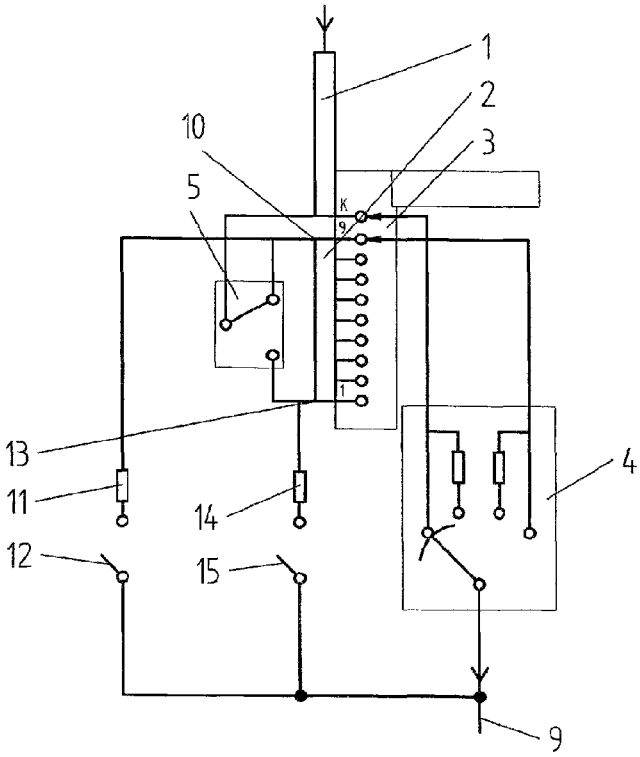
FIG. 2 shows a first embodiment of the invention according to patent claim 1.

FIG. 2 shows a first embodiment of the invention; the same components are provided with the same reference numerals.

In departure from the prior art, according to the invention provided at the start 10 of the tap winding 2 is a first polarity resistance 11 that is connected with the load shunt 9 by a first polarity switch 12. In addition, in accordance with the invention a second polarity resistance 14, which is connected again with the load shunt 9 by a second polarity switch 15, is provided at the end 13 of the tap winding 2. The two polarity switches 12, 15 are switched on only briefly before the start of actuation of the preselector 5, so that the start 10 and end 13 of the tap winding 2 are coupled to a defined potential only temporarily.

Figure 3:
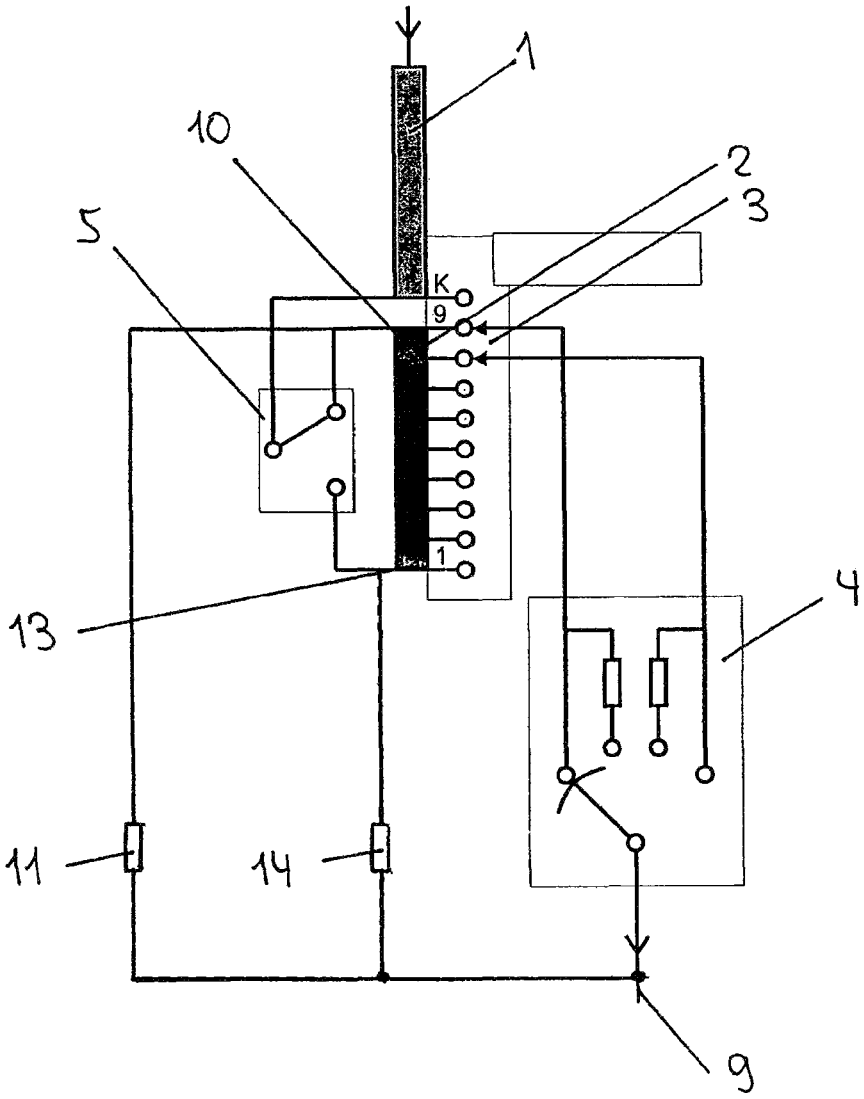
FIG. 3 shows a second embodiment of the invention according to patent claim 2.

FIG. 3 shows a second embodiment of the invention in which no polarity switches are provided. Rather, here a first polarity resistance 11 is coupled fixedly and permanently to the start of the tap winding 2 and a second polarity switch 14 is coupled fixedly and permanently to the end 13 of the tap winding 2. In this embodiment of the invention the mechanical outlay is less, since, as explained, separate polarity switches are omitted; on the other hand, the disadvantageous higher losses due to permanent connecting-in of the polarity resistances 11, 14 have to be accepted.

Ultimately, a decision on which of the two variants is a matter of discretion within the scope of the invention. Both forms of embodiments can be realized in single-phase tap changers without substantial effort.

In particularly advantageous manner, in both forms of embodiment the polarity resistances 11, 14 can be of asymmetrical design so that the specific polarity conditions at respective transformers can be adjusted or made comparable in simple manner.

The invention claimed is:

1. In combination:

a regulating transformer having a main winding having an end and a tap winding having a start, an end, and a plurality of taps;

a tap changer connected to a load shunt and selectably connectable to the taps;

a preselector connected to the start and end of the tap winding and to the end of the main winding;

a first polarity resistor connected between the start of the tap winding and the load shunt; and a second polarity resistor connected between the end of the tap winding and the load shunt.

2. The combination defined in claim 1, further comprising:

a changeover switch connected between the load shunt and the tap changer.

3. The combination defined in claim 1, further comprising:

respective first and second openable switches connected in series with the first and second resistors between the start and end of the tap winding and the load shunt.

4. The combination defined in claim 1, wherein the first and second polarity resistors have different electrical values.

* * * * *